US009726996B2

(12) United States Patent
Kamiwaki et al.

(10) Patent No.: US 9,726,996 B2
(45) Date of Patent: Aug. 8, 2017

(54) WHITE TONER, WHITE TONER SET, AND COLORED TONER SET

(71) Applicant: FUJI XEROX CO., LTD., Tokyo (JP)

(72) Inventors: Satoshi Kamiwaki, Kanagawa (JP); Tetsuya Taguchi, Kanagawa (JP); Shotaro Takahashi, Kanagawa (JP); Masaru Takahashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/061,078

(22) Filed: Mar. 4, 2016

(65) Prior Publication Data

US 2017/0090319 A1 Mar. 30, 2017

(30) Foreign Application Priority Data

Sep. 28, 2015 (JP) ..... 2015-189175

(51) Int. Cl.

| | |
|---|---|
| ***G03G 9/08*** | (2006.01) |
| ***G03G 9/09*** | (2006.01) |
| ***G03G 9/087*** | (2006.01) |

(52) U.S. Cl.

CPC ..... *G03G 9/09* (2013.01); *G03G 9/08755* (2013.01); *G03G 9/0902* (2013.01); *G03G 9/0904* (2013.01)

(58) Field of Classification Search

CPC ..... G03G 9/09; G03G 9/0902; G03G 9/0904; G03G 9/08755

USPC ..... 430/107.1, 109.4

See application file for complete search history.

(56) References Cited

U.S. PATENT DOCUMENTS 5,077,158 A 12/1991 Nakano

FOREIGN PATENT DOCUMENTS

JP H02-287370 A 11/1990

*Primary Examiner* — Mark A Chapman

(74) *Attorney, Agent, or Firm* — Oliff PLC

(57) ABSTRACT

A white toner includes white toner particles and black toner particles, wherein a content of the black toner particles is from 0.01% by number to less than 1% by number with respect to a total number of an entirety of toner particles.

10 Claims, 1 Drawing Sheet

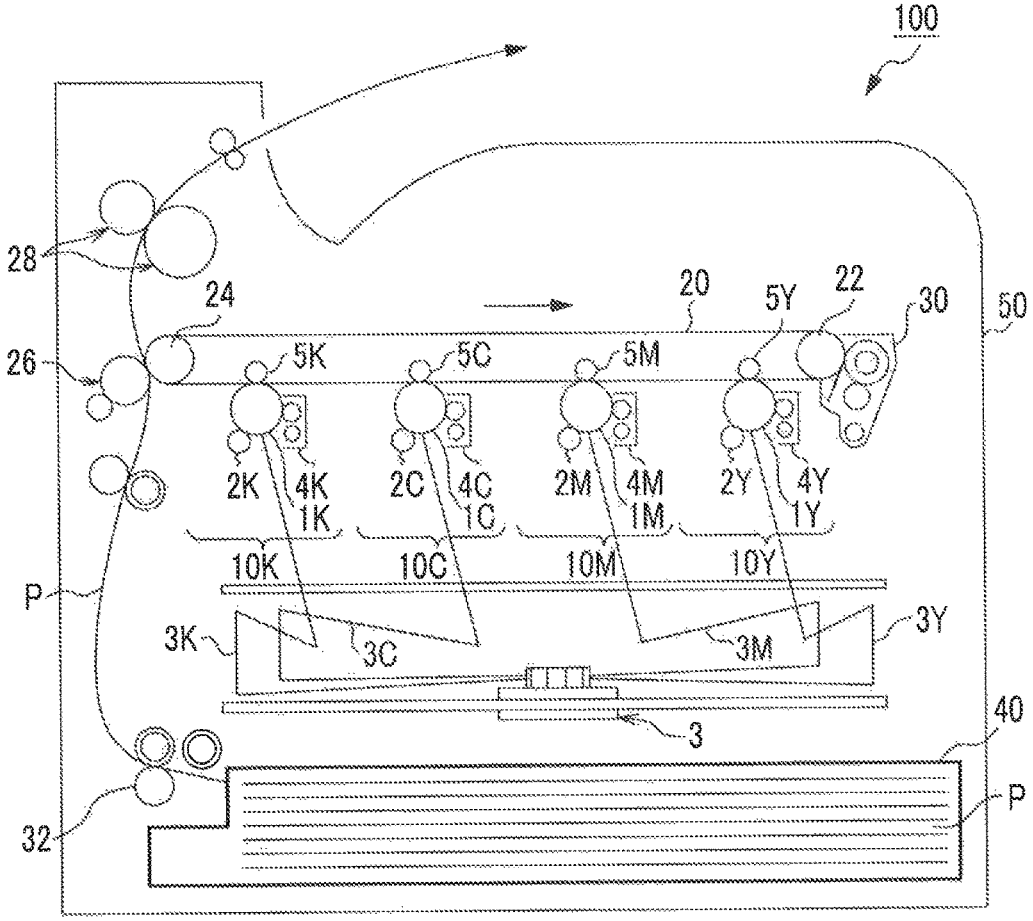
100
28
24
20
5Y
22
30
50
26
5K
5C
5M
2K
4K
1K
2C
4C
1C
2M
4M
1M
2Y
4Y
1Y
10K
10C
10M
10Y
P
3K
3C
3M
3Y
3
40
32
P

WHITE TONER, WHITE TONER SET, AND COLORED TONER SET

CROSS-REFERENCE TO RELATED APPLICATIONS

This application is based on and claims priority under 35 USC 119 from Japanese Patent Application No. 2015-189175 filed Sep. 28, 2015.

BACKGROUND

1. Technical Field

The present invention relates to a white toner, a white toner set, and a colored toner set.

2. Related Art

With advances in the electrophotographic technology, the opportunity to use image forming methods using a toner increases from the conventional use in offices to the use in the printing area including the printing of a small number of copies.

However, in many cases, an image obtained with a conventional toner is inferior in color reproducibility in comparison with the color reproduction of an image obtained with a printing ink which is used in usual printing, and thus there are restrictions when using a conventional toner in printing.

SUMMARY

According to an aspect of the invention, there is provided a white toner including:

white toner particles; and black toner particles, wherein a content of the black toner particles is from 0.01% by number to less than 1% by number with respect to a total number of an entirety of toner particles.

BRIEF DESCRIPTION OF THE DRAWINGS

Exemplary embodiments of the present invention will be described in detail based on the following figures, wherein:

the FIGURE is a schematic diagram illustrating an example of a configuration of an image forming device favorably used in an exemplary embodiment.

DETAILED DESCRIPTION

Hereinafter, an exemplary embodiment will be described.

The numerical value range expressed as "A to B" indicates not only a range between A and B, but also a range including A and B at both ends of the range. For example, the numerical value range expressed as "A to B" indicates "from A to B" or "from B to A".

White Toner

A white toner of this exemplary embodiment contains white toner particles and black toner particles, and the content of the black toner particles is from 0.01% by number to less than 1% by number of the total number of the entirety of toner particles.

When the content of the black toner particles is less than 0.01% by number with respect to the total number of the entirety of toner particles, it is difficult to reproduce a slightly grayish white (off-white) color. In contrast, when the content of the black toner particles is greater than 1% by number, it is not adequate to reproduce a slightly grayish white color.

The content of the black toner particles in the white toner is measured through a method to be described later.

The white toner of this exemplary embodiment contains white toner particles and black toner particles.

The image whiteness degree of the white toner of this exemplary embodiment is preferably from 80% to 90%, and more preferably from 85% to 90%. The image whiteness degree is determined by the ISO whiteness degree (ISO 2470) with respect to a solid image having a white toner amount of 6 g/m$^2$. The solid image is an image having a coverage (area coverage) of 100%.

Both of the black toner particles and the white toner particles of the white toner contain toner mother particles containing a desired colorant and a binder resin, and an arbitrary external additive. That is, the black toner particles preferably contain black toner mother particles containing a black colorant and a binder resin, and the white toner particles preferably contain white toner mother particles containing a white colorant and a binder resin. Both of the binder resins of the black toner mother particles and the white toner mother particles preferably contain a polyester resin. The polyester resin contained in the black toner particle is preferably the same as the polyester resin contained in the white toner particle.

Hereinafter, a binder resin and a colorant, which are main components of the toner mother particles, and a release agent which is an arbitrary component will be described. Then, an external additive will be described.

Toner Mother Particles

The black toner particles and the white toner particles of the white toner used in this exemplary embodiment preferably contain toner mother particles containing a desired colorant and a binder resin, respectively.

Binder Resin

A binder resin which is used in the field of toners is widely used as the binder resin contained in the toner mother particles, and examples thereof include homopolymers derived from monomers such as styrenes, (meth)acrylic esters, and (meth)acrylonitriles, copolymers derived from two or more kinds of the monomers, and mixtures thereof. Copolymers of styrene monomers and (meth)acrylic monomers are preferable. The term "(meth)acrylic" means any one or both of "acrylic" and "methacrylic".

As the binder of the black toner particles and the binder resin of the white toner particles contained in the white toner of this exemplary embodiment, a polyester resin is preferable as described above.

The polyester resin used in this exemplary embodiment is synthesized by polycondensation of a polyol and a polycarboxylic acid component, or by polycondensation of a hydroxy carboxylic acid. As the polyester resin, a commercially available product or a synthesized product may be used.

Examples of the polycarboxylic acid component include aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid, and aromatic dicarboxylic acids such as dibasic acids such as phthalic acid, isophthalic acid, terephthalic acid, naphthalene-2,6-dicarboxylic acid, malonic acid, and mesaconic acid. Anhydrides or lower alkyl esters thereof are also used.

Examples of the tri- or higher-valent carboxylic acids include 1,2,4-benzene tricarboxylic acid, 1,2,5-benzene tricarboxylic acid, 1,2,4-naphthalene tricarboxylic acid, and anhydrides or lower alkyl esters thereof. These may be used alone or in combination of two or more kinds thereof.

Examples of the dihydric alcohol as the polyol include alkylene (2 to 4 carbon atoms) oxide adducts of bisphenol A (average addition mole number of 1.5 to 6) such as polyoxypropylene (2.2)-2,2-bis(4-hydroxyphenyl)propane and polyoxyethylene(2.2)-2,2-bis(4-hydroxyphenyl)propane, ethylene glycol, propylene glycol, neopentyl glycol, 1,4-butanediol, 1, 3-butanediol, 1, 6-hexanediol, and 1,9-nonanediol.

Examples of the tri- or higher-hydric alcohol include sorbitol, pentaerythritol, glycerol, and trimethyiolpropane.

The polyester resin which is used as the binder is classified broadly into a non-crystalline polyester resin (also referred to as "amorphous polyester resin") and a crystalline polyester resin.

The "crystalline polyester resin" is a resin having a distinct endothermic peak in differential scanning calorimetry (DSC). Specifically, it means a resin in which a half-value width of an endothermic peak is within 6° C. when being measured at a rate of temperature increase of 10° C./min. A resin in which a half-value width of an endothermic peak is greater than 6° C., or a resin having no distinct endothermic peak is a non-crystalline (amorphous) resin.

In the synthesis of the amorphous polyester resin, a di- or higher-hydric secondary alcohol and/or a di- or higher-valent aromatic carboxylic acid compound is preferable among the above-described raw material monomers. Examples of the di- or higher-hydric primary or secondary alcohol include ethylene oxide adduct of bisphenol A, propylene oxide adduct of bisphenol A, propylene glycol, 1,3-butanediol, and glycerol. Among these, propylene oxide adduct of bisphenol A is preferable.

As the di- or higher-valent aromatic carboxylic acid compound, terephthalic acid, isophthalic acid, phthalic acid, and trimellitic acid are preferable, and terephthalic acid and trimellitic acid are more preferable.

The crystalline polyester resin is preferably used in combination with the amorphous polyester resin in order to impart low-temperature fixability to the toner.

The crystalline polyester resin is preferably composed of an aliphatic dicarboxylic acid and an aliphatic diol, and a linear dicarboxylic acid and a linear aliphatic diol in which the number of carbon atoms of a main chain portion is 4 to 20 are more preferably used. When the components are linear, the polyester resin has excellent crystallinity and an appropriate crystalline melting point, and thus excellent toner blocking resistance, image preservability, and low-temperature fixability are obtained. When the number of carbon atoms is 4 or greater, the concentration of ester bonds is low, the electric resistance is appropriate, and excellent toner chargeability is obtained. When the number of carbon atoms is 20 or less, the practical availability of materials is facilitated. The number of carbon atoms is more preferably 14 or less.

Examples of the aliphatic dicarboxylic acid favorably used in the synthesis of the crystalline polyester resin include, but are not limited to, oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, and lower alkyl esters or anhydrides thereof. Among these, sebacic acid and 1,10-decanedicarboxylic acid are preferable in consideration of availability.

Specific examples of the aliphatic diol include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1, 14-tetradecanediol, 1,18-octadecanediol, and 1,14-eicosanedecanediol. Among these, 1,8-octanediol, 1,9-nonanediol, and 1,10-decanediol are preferable in view of availability.

Examples of the tri- or higher-hydric alcohol include glycerin, trimethylolethane, trimethylolpropane, and pentaerythritol. These may be used alone or in combination of two or more kinds thereof.

Among the polycarboxylic acid components, polycarboxylic acid components in which the content of the aliphatic dicarboxylic acid is 80 mol % or greater are preferable, and polycarboxylic acid components in which the content of the aliphatic dicarboxylic acid is 90 mol % or greater are more preferable. When the content of the aliphatic dicarboxylic acid is 80% or greater, the polyester resin has excellent crystallinity and an appropriate melting point, and thus excellent toner blocking resistance, image preservability, and low-temperature fixability are obtained.

Among the polyol components, polyol components in which the content of the aliphatic diol component is 80 mol % or greater are preferable, and polyol components in which the content of the aliphatic diol component is 90 mol % or greater are more preferable. When the content of the aliphatic diol component is 80 mol % or greater, the polyester resin has excellent crystallinity and an appropriate melting point, and thus excellent toner blocking resistance, image preservability, and low-temperature fixability are obtained.

In this exemplary embodiment, a melting temperature Tm of the crystalline polyester resin is preferably from 50° C. to 100° C., more preferably from 50° C. to 90° C., and even more preferably from 50° C. to 80° C. The melting temperature is preferably within the above range since excellent peelability and low-temperature fixability are obtained, and the offset is reduced.

Here, the melting temperature of the crystalline polyester resin is measured using a differential scanning calorimeter, and may be obtained as a melting peak temperature of the input compensation differential scanning calorimetry prescribed in JIS K-7121:87 when the measurement is performed at a rate of temperature increase of 10° C./min from room temperature (20° C.) to 180° C. The crystalline polyester resin sometimes shows plural melting peaks, but in this exemplary embodiment, the maximum peak is regarded as the melting temperature.

A glass transition temperature (Tg) of the non-crystalline polyester resin is preferably 30° C. or higher, more preferably from 30° C. to 100° C., and even more preferably from 50° C. to 80° C. When the glass transition temperature is within the above range, the resin is in a glass state during use, and therefore, the toner particles do not aggregate by the heat or pressure applied during the formation of an image, and do not adhere and deposit in the machine, so that stable image forming ability is obtained for a long period of time.

Here, the glass transition temperature of the non-crystalline polyester resin is a value measured through the method (DSC method) specified in ASTM D3418-82.

In this exemplary embodiment, the glass transition temperature may be measured according to, for example, differential scanning calorimetry by using, for example, "DSC-20" (manufactured by Seiko Instruments Inc.). Specifically, approximately 10 mg of a sample is heated at a constant rate of temperature increase (10° C./min, and the glass transition temperature is obtained from the intersection point between the base line and the inclined line of the endothermic peak.

The weight average molecular weight of the crystalline polyester resin is preferably from 10,000 to 60,000, more preferably from 15,000 to 45,000, and even more preferably from 20,000 to 30,000.

The weight average molecular weight of the amorphous polyester resin is preferably from 5,000 to 100,000, more preferably from 10,000 to 90,000, and even more preferably from 20,000 to 80,000.

Each of the weight average molecular weights of the crystalline polyester resin and the amorphous polyester resin is preferably within the above numerical value range since the image strength and the fixability are balanced. All of the above-described weight average molecular weights are obtained by the measurement of the molecular weight of tetrahydrofuran (THF) solubles by gel permeation chromatography (GPC). The molecular weight of the resin is calculated by measuring a THF soluble material in a THF solvent using TSK-GEL (GMH (manufactured by Tosoh Corporation)) or the like, and using the molecular weight calibration curve obtained from a monodisperse polystyrene standard sample.

The acid values of the crystalline polyester resin and the non-crystalline polyester resin are preferably from 1 mgKOH/g to 50 mgKOH/g, more preferably from 5 mgKOH/g to 50 mgKOH/g, and even more preferably from 8 mgKOH/g to 50 mgKOH/g. The acid value is preferably within the above range since excellent fixing characteristics and charging stability are obtained.

If necessary, a monovalent acid such as an acetic acid or a benzoic acid, or a monohydric alcohol such as a cyclohezanol benzyl alcohol is also used in order to adjust the acid value or the hydroxyl value.

The method of preparing a polyester resin is not particularly limited, and the polyester resin may be prepared through a usual polyester polymerization method including reacting an acid component with an alcohol component. Examples thereof include direct polycondensation and an ester exchange method, and the preparing is performed using a different method according to the kind of the monomer. In addition, a polycondensation catalyst such as a metal catalyst or a Bronsted acid catalyst is preferably used.

The polyester resin may be prepared by causing a condensation reaction of the polyol with the polycarboxylic acid in the usual manner. For example, the polyol, the polycarboxyiic acid, and if necessary, a catalyst are put and blended in a reaction vessel equipped with a thermometer, a stirrer, and a falling-type condenser, the blend is heated at 150° C. to 250° C. in the presence of an inert gas (such as nitrogen gas), low-molecular compounds as by-products are continuously removed out of the reaction system, the reaction is stopped at the time of reaching a predetermined acid value or molecular weight, and after cooling, the objective reaction product is obtained. Thus, the resin is prepared.

The content of the binder resin in the toner mother particles is not particularly limited, but is preferably from 10% by weight to 95% by weight, more preferably from 25% by weight to 90% by weight, and even more preferably from 35% by weight to 85% by weight with respect to the total weight of the toner. When the content is within the above range, excellent fixability, charging characteristics, and the like are obtained.

Colorant

In this exemplary embodiment, the toner mother particles of the white toner particles contain a white colorant, and the toner mother particles of the black toner particles contain a black colorant.

As the colorant, a known colorant may be used, and it may be a dye or a pigment. From the viewpoint of light resistance and water resistance, the colorant is preferably a pigment.

Examples of the black colorant include carbon black, activated carbon, titanium black, magnetic powder, and non-magnetic powder containing manganese, and carbon black is preferable.

Examples of the white colorant include zinc white, titanium oxide, antimony white, zinc sulfide, and alumina. Titanium oxide and alumina are preferable, and titanium oxide (titania) is more preferable.

The colorant may be surface-treated or used in combination with a pigment dispersant.

The amounts of the colorants respectively used in the white toner particles and in the black toner particles are not particularly limited. In the black toner particles, the amount of the colorant is preferably from 1.0 part by weight to 30 parts by weight with respect to 100 parts by weight of the toner mother particles. In the white toner, the content of the white pigment is relatively large, and is thus preferably from 10 parts by weight to 70 parts by weight, and more preferably from 20 parts by weight to 60 parts by weight with respect to 100 parts by weight of the toner mother particles. As the colorant, the pigment may be used alone or in combination of two or more kinds thereof.

Release Agent

In this exemplary embodiment, the toner mother particles of the white toner particles and the black toner particles preferably contain a release agent.

Preferable examples of the release agent include ester wax, polyethylene, polypropylene, and copolymer of polyethylene and polypropylene, and specific examples thereof include unsaturated fatty acids such as polyglycerin wax, microcrystalline wax, paraffin wax, carnauba wax, Sasol wax, montanoic acid ester wax, deoxidized carnauba wax, palmitic acid, stearic acid, montanoic acid, brassidic acid, eleostearic acid, and parinaric acid, saturated alcohols such as stearyl alcohol, aralkyl alcohol, biphenyl alcohol, carnaubyl alcohol, ceryl alcohol, melissyl alcohol, and long-chain alkyl alcohols having a long chain alkyl group; polyols such as sorbitol; fatty acid amides such as linoleic acid amide, oleic acid amide, and lauric acid amide; saturated fatty acid bis-amides such as methylene bis-stearic acid amide, ethylene bis-capric acid amide, ethylene bis-lauric acid amide, and hexamethylene bis-stearic acid amide, unsaturated fatty acid amides such as ethylene bis-oleic acid amide, hexamethylene bis-oleic acid amide, N,N'-dioleoyl adipic acid amide, and N,N'-dioleoyl sebacic acid amide; aromatic bis-amides such as m-xylene bis-stearic acid amide and N,N'-distearylisophthalic acid amide; fatty acid metal salts such as calcium stearate, calcium laurate, zinc stearate, and magnesium stearate (generally called metal soap); wax obtained through grafting a vinyl monomer such as styrene or acrylic acid to aliphatic hydrocarbon wax; partially esterified material of fatty acid and polyol such as monoglyceride behenate; and methylester compound having a hydroxyl group obtained by hydrogenation of vegetable oil.

The release agents may be used alone or in combination of two or more kinds thereof.

The content of the release agent is preferably from 1 part by weight to 20 parts by weight, and more preferably from 3 parts by weight to 15 parts by weight with respect to 100 parts by weight of the black toner mother particles or the white toner mother particles. When the content is within the above range, good fixing and good image characteristics may be balanced.

Charging Polarity

In this exemplary embodiment, in order to control the chargeability of the toner mother particles and the toner, the toner mother particles may be surface-treated, or a charge controlling agent may be added to the toner mother particles. However, the toner mother particles are preferably surface-treated.

In many cases, the toner mother particles are negatively-charged toner mother particles when the chargeability is not particularly controlled.

Preferable examples of the surface treatment method for positively charging the toner mother particles include a method of reacting or adhering a polyallylamine, polyaminopropyl biguanide (polyhexanide), polyethyleneimine, or the like to the surfaces of the toner mother particles.

External Additive

The white toner particles and the black toner particles in the white toner used in this exemplary embodiment may contain an external additive.

Silica particles and/or titania particles are preferably exemplified as the external additive.

Other Components

In this exemplary embodiment, the white toner may contain other components in addition to the above-described components. Other components are not particularly limited, and known components are exemplified. Examples thereof include a lubricant and an abrading agent.

Characteristics of White Toner

The content of the black toner particles in the white toner is measured by an image treatment of an image observed by an optical microscope. The observation magnification is 500 times, and the number of particles to be measured is 100,000 or more.

In the measurement, sampled white toner particles are observed by an optical microscope on a glass slide, and the observed image is taken in an image analyzer (LUZEX III, manufactured by Nireco Corporation) through a video camera, and is analyzed to obtain the content of the black toner particles. The total number of the sampled white toner particles is 100,000 to measure the content of the black toner particles.

A volume average particle diameter $R_B$ of the black toner particles and a volume average particle diameter $R_W$ of the white toner particles contained in the white toner are also obtained by an image treatment of an image observed by an optical microscope.

All of the volume average particle diameters of the white toner particles and the black toner particles in the white toner used in this exemplary embodiment are preferably from 2 μm to 9 μm. When the volume average particle diameters are within the above ranges, the effects of this exemplary embodiment are remarkably exhibited.

Method of Preparing White Toner

The white toner used in this exemplary embodiment is prepared by mixing, with the white toner particles, the black toner particles such that the content of the black toner particles is from 0.01% by number to less than 1% by number of the total number of the entirety of toner particles. The method of preparing the black toner particles and the white toner particles is not particularly limited, and the particles are prepared by a dry method such as a kneading and pulverization preparing method, or a wet method such as an aggregation and coalescence method, which are known well. Among these methods, an aggregation and coalescence method is preferable.

Hereinafter, using a case in which a polyester resin is used as the binder resin as an example, a method of preparing raw material toner particles (black toner particles or white toner particles) will be described in detail.

The aggregation and coalescence method has a dispersion process of preparing particles of a raw material of a toner, an aggregation process of forming aggregates of the raw material particles, and a coalescence process of coalescing the aggregates.

Dispersion Process

Hereinafter, a case in which a polyester resin is used as the binder resin will be described.

A polyester resin particle dispersion is prepared by dispersing a dissolved polyester resin in water. A polyester resin having an acid group is preferably used in order to facilitate the dispersion, and an alkali metal hydroxide and/or a surfactant is/are preferably used in combination for the dispersion. The dispersion is preferably performed using a dispersing machine such as a twin-screw kneading extruder under a shear force generated by the dispersing machine. In this regard, the viscosity of the polyester resin is more preferably lowered by heating to form polyester resin particles. The dispersion is preferably performed without using an organic solvent.

Preferable examples of the dispersion medium include water such as distilled water and ion exchanged water; and alcohols, and the dispersion medium is preferably only water.

Examples of the surfactant used in the dispersion process include anionic surfactants such as sodium dodecylbenzenesulfonate, sodium octadecylsulfate, sodium oleate, sodium laurate, and potassium stearate, cationic surfactants such as laurylamine acetate, stearylamine acetate, and lauryltrimethylammonium chloride, amphoteric ionic surfactants such as lauryldimethylamine oxide, and nonionic surfactants such as polyoxyethylene alkyl ether, polyoxyethylene alkyl phenyl ether, and polyoxyethylene alkyl amine, and anionic surfactants are preferable.

Examples of the dispersing machine used in the preparation of the resin particle dispersion include a homogenizer, a homomixer, a pressure kneader, and an extruder such as a twin-screw kneading extruder.

As the size of the resin particles, the average particle diameter (volume average particle diameter) thereof is preferably in the range of from 60 nm to 300 nm, and more preferably in the range of from 150 nm to 250 nm. When the size of the resin particles is within the above range, the resin particles have sufficient aggregation properties, and the particle diameter distribution of the toner may be narrowed.

In the preparation of a release agent dispersion, a release agent is dispersed together with an ionic surfactant or a polyelectrolyte such as a polymer acid or a polymer base in water, and then a dispersion treatment is performed using a homogenizer or a pressure discharge-type dispersing machine capable of applying a strong shear force simultaneously with heating to a temperature which is not lower than the melting temperature of the release agent. The release agent dispersion may be obtained through such a treatment.

Through the dispersion treatment, a release agent dispersion containing release agent particles preferably having a volume average particle diameter of 1 μm or less may be obtained. The volume average particle diameter of the release agent particles is more preferably from 100 nm to 500 nm.

Aggregation Process

In the aggregation process, it is preferable that the resin particle dispersion, the release agent dispersion, a colorant (carbon black or titanium white) particle dispersion, and the like are mixed to prepare a mixture, and heated at a temperature which is not higher than the glass transition temperature of the non-crystalline resin particles to aggregate the resin particles, thereby forming aggregated particles. The aggregate, particles are formed with stirring by adjusting the pH of the mixture to acidic.

The pH is preferably in the range of from 2 to 7, more preferably in the range of from 2.2 to 6, and even more preferably in the range of from 2.4 to 5 in view of narrowing the particle size distribution of the toner. It is also effective to use an aggregating agent.

In the aggregation process, the release agent dispersion may be added and mixed together with various dispersions such as the resin particle dispersion at once or in plural portions.

As the aggregating agent, a di- or higher-valent metal complex is favorably used, as well as a surfactant having a polarity opposite to that of the surfactant used as the dispersant, and an inorganic metal salt. Since the amount of the surfactant to be used may be reduced and the charging characteristics are improved, the metal complex is particularly preferably used.

Examples of the inorganic metal salt include metal salts such as calcium chloride, calcium nitrate, barium chloride, magnesium chloride, zinc chloride, aluminum chloride, and aluminum sulfate, and inorganic metal salt polymers such as polyaluminum chloride, polyaluminum hydroxide, and calcium polysulfide. Among these, aluminum salt and polymers thereof are particularly preferable.

In addition, when the aggregated particles have a desired particle diameter, the resin particles may be further added (coating process) to prepare a toner having a configuration in which surfaces of core aggregated particles are coated with the resin particles. In this case, the release agent is not easily exposed to the toner surface, and thus the configuration is preferable from the viewpoint of chargeability and developability. In the case of further addition, the aggregating agent may be added or the pH may be adjusted before further addition.

Coalescence Process

In the coalescence process, it is preferable that the progression of the aggregation is stopped by increasing the pH of the suspension of the aggregated particles to a range of from 3 to 9 under stirring conditions based on the aggregation process, and the aggregated particles are coalesced by performing heating at a temperature which is not lower than the melting temperature of the crystalline resin. In addition, when the aggregated particles are coated with the non-crystalline resin, it is preferable that the non-crystalline resin is also coalesced and the core aggregated particles are coated therewith. Regarding the heating time, the heating may be performed to the extent that the coalescence is caused, and may be preferably performed for 0.5 hours to 10 hours.

After the coalescence, cooling is performed to obtain coalesced particles. In the cooling process, crystallization may be promoted by lowering the cooling rate at around the melting temperature of the crystalline resin (melting temperature ±10° C.), that is, so-called slow cooling.

The coalesced particles (toner mother particles) obtained by coalescence are subjected to a solid-liquid separation process such as filtration, and if necessary, a washing process and a drying process, and thus toner mother particles may be obtained.

A process of externally adding an external additive to the obtained toner mother particles is preferably performed.

The method of externally adding an external additive to surfaces of the toner mother particles in the external addition process is not particularly limited, and a known method is used. Examples thereof include a method of adhering an external additive through a mechanical method or a chemical method.

If necessary, coarse particles in the toner may be removed after external addition using an ultrasonic sieving machine, a vibration sieving machine, an air sieving machine, or the like.

Electrostatic Charge Image Developer

An electrostatic charge image developer of this exemplary embodiment (hereinafter, also simply referred to as "developer") contains at least the electrostatic charge image developing toner of this exemplary embodiment, and may contain known other components, if necessary.

(1) Single-Component Developer

The developer according to this exemplary embodiment may be a single-component developer. In the case of the single-component developer, it may be a magnetic single-component developer containing magnetic metal particles, or a non-magnetic single-component developer containing no magnetic metal particles.

In this exemplary embodiment, a non-magnetic single-component developer is preferable. In the case of the non-magnetic single-component developer, the white toner of this exemplary embodiment is preferably used without changes as the developer (non-magnetic single-component developer), and is favorably used as the electrostatic charge image developing toner by a non-magnetic single-component contact development method.

(2) Two-Component Developer

When used as a two-component developer, the white toner of this exemplary embodiment and a carrier are mixed and used.

The carrier which may be used in the two-component developer is not particularly limited, and examples thereof include magnetic metals such as iron oxide, nickel, and cobalt, magnetic oxides such as ferrite and magnetite, resin-coated carriers having a resin coating layer on surfaces of the cores, and magnetic dispersion-type carriers. Furthermore, the carrier may be a resin dispersion-type carrier in which a conductive material or the like is dispersed in a matrix resin.

Examples of the coating resin and the matrix resin used in the carrier include, but are not limited to, polyethylene, polypropylene, polystyrene, polyvinyl acetate, polyvinyl alcohol, polyvinyl butylal, polyvinyl chloride, polyvinyl ether, polyvinyl ketone, vinyl chloride-vinyl acetate copolymer, styrene-acrylic ester copolymer, straight silicone resin having an organosiloxane bond or modified products thereof, fluorine resin, polyester, polycarbonate, phenol resin, and epoxy resin.

Examples of the conductive material include, but are not limited to, metals such as gold, silver, and copper, carbon black, titanium oxide, zinc oxide, barium sulfate, aluminum borate, potassium titanate, and tin oxide.

Examples of the core of the carrier include magnetic metals such as iron, nickel, and cobalt, magnetic oxides such as ferrite and magnetite, and glass beads. Magnetic materials may be used in order to use the carrier in a magnetic brush method.

The volume average particle diameter of the core of the carrier is, for example, in the range of from 10 μm to 500 μm, and preferably in the range of from 30 μm to 100 μm.

Examples of the method of coating the surface of the core of the carrier with a resin include a method of performing coating using a coating layer forming solution in which the coating resin and various additives as necessary are dissolved in a solvent. The solvent is not particularly limited, and may be appropriately selected in consideration of the coating resin to be used, application properties, and the like.

Specific examples of the resin coating method include a dipping method of dipping the core of the carrier in a coating layer forming solution, a spray method of spraying a coating layer forming solution to the surface of the core of the carrier, a fluidized bed method of spraying a coating layer forming solution in a state in which the core of the carrier is made to float by the use of an air flow, and a kneader-coater method of mixing the core of the carrier with a coating layer forming solution in a kneader coater to remove the solvent.

The mixing ratio (weight ratio) of the white toner and the carrier in the two-component developer is, for example, in the range of from 1:100 to 30:100 (white toner:carrier), and may be in the range of from 3:100 to 20:100.

The method of mixing the carrier with the toner is not particularly limited, and these may be mixed using a known device such as a V-blender or a known method.

Method of Preparing White Toner

The white toner is prepared by mixing and uniformly agitating black toner particles and white toner particles. Specifically, the black toner particles, the white toner particles, and an external additive may be mixed and agitated together. Black toner particles which are externally added may be mixed with white toner particles which are externally added likewise. A white toner previously prepared before installation in an image recording device may be used, and a white toner may be prepared by mixing black toner particles with white toner particles at a desired ratio in the image recording device. A master toner containing approximately 10% by number of black toner particles may be separately prepared, and may be mixed with white toner particles and agitated to prepare a white toner.

Toner Set

In this exemplary embodiment, a white toner set including two or more kinds of white toners having different whiteness degrees is favorably used. For example, when the white toner is used as a correction ink, that is, when an unnecessary text portion on a recording sheet is hidden, a white toner having a whiteness degree close to a whiteness degree of the recording sheet is selected and used. When the white toner having a whiteness degree close to the whiteness degree of the recording sheet is used, the corrected places are inconspicuous. In this case, the correction ink is used to hide a part of the recording sheet, but is not used to undercoat the entire surface of the recording sheet or the entire surface of a central portion excluding the peripheral portion of the recording sheet.

The whiteness degree of the recording sheet may be previously detected with a sensor to use, as a correction ink, a white toner having a whiteness degree close to the detected whiteness degree.

In addition, when the white toner is used in the image reproduction, a white toner having an appropriate whiteness degree is selected in order to reproduce the delicate shadow in the white color. For example, a white toner having a whiteness degree different from a whiteness degree of a recording sheet is preferably used from the viewpoint of color reproduction in order to reproduce the shadow of a thick cloud or a shady white wall. When the recording sheet is fine quality paper having a high whiteness degree, a white toner having a lower whiteness degree than the whiteness degree is preferably used in view of the color reproduction, and when the recording sheet is recycled paper having a low whiteness degree, a white toner having a higher whiteness degree than the whiteness degree is preferably used in view of reproducing a slightly grayish white color. When only a black toner is provided, tone reproduction becomes difficult since the difference in the tone is small in a low coverage.

In this exemplary embodiment, a colored toner set containing the white toner and at least one kind of colored toner is also useful. The colored toner is preferably at least one of a yellow (Y) toner, a magenta (M) toner, a cyan (C) toner, and a black toner, and in the full-color printing, at least YMC toners of three primary colors of the subtractive color process are used in combination.

Known toner colorants are used as colorants of the yellow (Y) toner, the magenta (M) toner, the cyan (C) toner, and the black toner.

Image Forming Method

An image forming method using the white toner of this exemplary embodiment will be described. The electrostatic charge image developer of this exemplary embodiment is used in an image forming method using a known electrophotographic method. Specifically, the electrostatic charge image developer is used in an image forming method having the following processes.

A preferable image forming method includes a latent image forming process of forming an electrostatic latent image on a surface of an image holding member, a developing process of developing the electrostatic latent image formed on the surface of the image holding member with a developer containing the white toner of this exemplary embodiment to form a toner image, a transfer process of transferring the toner image onto a recording sheet, and a fixing process of fixing the toner image transferred onto the recording sheet. In the transfer process, an intermediate transfer member may be used to mediate the transfer of the toner image of the electrostatic latent image from the image holding member to the recording sheet.

A cleaning process of removing the residual toner on the surface of the image holding member after the transfer is also preferably included.

Each of the processes itself is a usual process. The image forming method of this exemplary embodiment may be conducted using a known image forming device such as a copier or a fax.

The electrostatic latent image forming process is a process of forming an electrostatic latent image on an image holding member (photoreceptor).

The developing process is a process of developing the electrostatic latent image with a developer layer on a developer holding member to form a toner image. The developer layer is not particularly limited as long as it includes a developer containing the white toner of this exemplary embodiment.

The transfer process is a process of transferring the toner image onto a recording sheet. Examples of the recording sheet include various kinds of paper such as fine quality paper and recycled paper. Coating paper in which a surface of plain paper is coated with a resin or the like, art paper for printing, or the like is also used. The ISO whiteness degree of the recording sheet is preferably from 60% to 95%.

Examples of the fixing process include a method of fixing the toner image transferred onto the transfer paper by a heating roller fixing machine in which the temperature of a heating roller is set to a constant temperature to form a copy image.

The cleaning process is a process of removing the electrostatic charge image developer remaining on the image holding member.

The image forming method of this exemplary embodiment may further include a recycling process. The recycling process is a process of moving the toner collected in the cleaning process to the developer layer. The image forming method including this recycling process is conducted using an image forming device such as a copier or a fax of a toner recycling system type. It also may be applied to a recycling system in which the cleaning process is omitted and the collection of the toner is performed simultaneously with the developing.

When the white toner is used as a correction ink, a white toner having a whiteness degree close to a whiteness degree of a recording sheet is preferably selected. In this case, the white toner is applied to an unnecessary text or the like with a high coverage.

When the white toner is used in the full-color reproduction, a white toner having an optimum whiteness degree for reproducing a so-called off-white image portion in a color image to be reproduced is preferably selected previously.

When the white toner is used in the color reproduction in which the off-white reproduction is emphasized, a white toner having an optimum whiteness degree in the relationship with a whiteness degree of a recording sheet is preferably selected. For example, when the recording sheet is fine quality paper having a whiteness degree which is greater than 90%, a white toner having a whiteness degree of approximately 70% to 80% is preferably selected in order to reproduce the shadow of a cloud in the sky, a shady white wall, or the like. In contrast, when recycled paper having a whiteness degree of approximately 60% is used as the recording sheet, a white toner having a whiteness degree of approximately 80% to 90% is preferably used in order to reproduce the white color of highlights. In addition, a white toner having an appropriate whiteness degree is preferably selected according to the contents of an off-white image emphasized in a color image to be reproduced and the whiteness degree of a recording sheet to be used. By changing the whiteness degree and the coverage of the selected white toner, slightly different tones of the grayish off-white color are reproduced.

When the white toner is used on a recording sheet, the amount of the white toner applied thereon is preferably from 4 $g/m^2$ to 8 $g/m^2$, and more preferably from 4.5 $g/m^2$ to 6 $g/m^2$ in a solid image.

When the white toner is used on a transparent support such as polyethylene terephthalate (PET), the amount of the white toner is preferably from 5 $g/m^2$ to 8 $g/m^2$, and more preferably from 6 $g/m^2$ to 7 $g/m^2$ in a solid image as in the above description.

The image forming method of this exemplary embodiment preferably further includes a process of detecting a whiteness degree of the recording sheet and a process of selecting a white toner having an image whiteness degree according to the detected whiteness degree.

A sensor for detecting the whiteness degree of the recording sheet is used in order to detect the whiteness degree. A white toner having an appropriate whiteness degree is preferably selected from the white toner set by storing and comparing the detected whiteness degree of the recording sheet with the whiteness degree of the white toner separately recorded.

When a colored toner set in which a white toner is added to full-color toners of yellow (Y), magenta (M), cyan (C), and black (K) is used, it is appropriate, as a preferable transfer order, that the white toner as a correction ink is initially transferred. The transfer order in the case of forming a full-color image of a cloud having a shadow is also the same as this order.

Toner Cartridge and Image Forming Device

An image forming device of this exemplary embodiment includes a white toner image forming unit which forms a white toner image of the white toner of this exemplary embodiment on a recording sheet, and preferably further includes a color toner forming unit which forms a color image of three primary color toners (CMYK) on the recording sheet.

Hereinafter, an image forming device using an electrostatic charge image developer containing the white toner of this exemplary embodiment will be described.

The image forming device of this exemplary embodiment includes an image holding member, a charging unit which charges the image holding member, an electrostatic charge image forming unit which forms an electrostatic charge image on a surface of the charged image holding member, a developing unit which develops the electrostatic charge image with a developer containing the white toner of this exemplary embodiment to form a toner image, a transfer unit which transfers the toner image formed on the surface of the image holding member onto a surface of a recording sheet, and a fixing unit which fixes the toner image transferred onto the surface of the recording sheet.

The image forming device of this exemplary embodiment is not particularly limited as long as it includes at least the image holding member, the charging unit, the electrostatic charge image forming unit, the developing unit, the transfer unit, and the fixing unit as described above, and may include a cleaning unit, an erasing unit, and the like if necessary.

In the transfer unit, the transfer may be performed more than once using an intermediate transfer member. Examples of the intermediate transfer member include an intermediate transfer belt.

The image holding member and the units may preferably use the configurations described in the processes of the above-described image forming method. A known unit in the image forming device may be used as each of the units. The image forming device of this exemplary embodiment may include a unit or a device other than those having the above-described configurations. In addition, the image forming device of this exemplary embodiment may simultaneously perform more than one of the above-described units.

In this image forming device, for example, a portion including the developing unit may be a cartridge structure (process cartridge) is detachable from the image forming device, and as the process cartridge, a process cartridge which includes at least a developer holding member and accommodates an electrostatic charge image developing developer containing the white toner of this exemplary embodiment is favorably used.

The developer cartridge of this exemplary embodiment is a developer cartridge which contains at least the white toner of this exemplary embodiment.

The developer cartridge of this exemplary embodiment may be a developer cartridge containing the white toner of this exemplary embodiment, and is not particularly limited. For example, the developer cartridge is detachable from the image forming device including the developing unit, and stores a developer containing the white toner of this exemplary embodiment as a developer for being supplied to the developing unit.

In addition, the developer cartridge may be a cartridge storing a toner and a carrier, or a cartridge independently storing a toner and a cartridge independently storing a carrier may be provided separately from each other.

the FIGURE is a schematic diagram showing an example of a configuration of a tandem-type image forming device for forming an image through the image forming method of this exemplary embodiment. In an image forming device 100 shown in FIG. 1, four electrophotographic photoreceptors (image holding members) 1Y, 1M, 1C, and 1K are arranged in parallel to each other along an intermediate transfer belt 20, respectively, in four color image forming units 10Y, 10M, 10C, and 10K in a housing 50. Regarding the electrophotographic photoreceptors 1K, 1C, 1M, and 1Y, for example, the electrophotographic photoreceptor 1Y may form a yellow image, the electrophotographic photoreceptor 1M may form a magenta image, the electrophotographic photoreceptor 1C may form a cyan image, and the electrophotographic photoreceptor 1K may form a black image, respectively. An electrophotographic photoreceptor 1W (not shown) may be provided behind the electrophotographic photoreceptor 1K to form a white image by the white toner of this exemplary embodiment. In this case, the intermediate transfer is preferably performed in the order of Y→M→C→K→W in the image forming device. In the case of using an intermediate transfer belt, a white toner image is finally transferred onto the intermediate transfer belt in order to initially transfer the white toner to a recording sheet.

Each of the electrophotographic photoreceptors 1Y, 1M, 1C, and 1K may be rotated in a predetermined direction (counterclockwise direction on the paper), and charging rolls 2Y, 2M, 2C, and 2K, developing devices 4Y, 4M, 4C, and 4K, and primary transfer rolls 5Y, 5M, 5C, and 5K are arranged along the rotation direction. In this case, each electrophotographic photoreceptor and each developing device are configured to be mounted as the same unit, that is, a process cartridge. The primary transfer rolls 5Y, 5M, 5C, and 5K abut against the electrophotographic photoreceptors 1Y, 1M, 1C, and 1K via the intermediate transfer belt 20, respectively.

An exposure device 3 is disposed at a predetermined position in the housing 50, and light beams emitted from the exposure device 3 may be applied to surfaces of the electrophotographic photoreceptors 1Y, 1M, 1C, and 1K after charging. Therefore, the charging process, the exposure process, the developing process, and the primary transfer process are sequentially performed in the process of rotating the electrophotographic photoreceptors 1Y, 1M, 1C, and 1K, and the respective color toner images are superimposed and transferred onto the intermediate transfer belt 20.

Here, the charging rolls 2Y, 2M, 2C, and 2K apply a voltage to the photoreceptors by contacting a conductive member (charging roll) with the surfaces of the electrophotographic photoreceptors 1Y, 1M, 1C, and 1K to charge the surfaces of the photoreceptors to a predetermined potential (charging process). The charging may be performed based on a contact charging method using a charging brush, a charging film, a charging tube, or the like, in addition to the charging roll showing in this exemplary embodiment. The charging may be performed based on a non-contact method using corotron or scorotron.

As the exposure device 3, an optical device or the like which may imagewise expose in a desired manner the surface of each of the electrophotographic photoreceptors 1Y, 1M, 1C, and 1K to light emitted from a light source such as a semiconductor laser, a light emitting diode (LED), or a liquid crystal shutter may be used.

As the developing devices 4Y, 4M, 4C, and 4K, a usual developing device which performs the developing by contact with a non-magnetic single-component developer or a two-component developer to be described later may be used (developing process). Such a developing device is not particularly limited as long as it uses a non-magnetic single-component developer or a two-component developer, and a known developing device may be appropriately selected according to the purpose. In the primary transfer process, the respective color toners are sequentially and primarily transferred from the image holding members to the intermediate transfer belt 20 by applying a primary transfer bias having a polarity opposite to that of the toner on the image holding member to the primary transfer rolls 5Y, 5M, 5C, and 5K.

The intermediate transfer belt 20 is supported at a predetermined tension by a drive roll 22 and a backup roll 24, and may be rotated by the rotation of these rolls without generating flexure. Also, a secondary transfer roll 26 is disposed to abut against the backup roll 24 via the intermediate transfer belt 20.

A secondary transfer bias having a polarity opposite to that of the toner on the intermediate transfer belt 20 is applied to the secondary transfer roll 26, whereby the toner is secondarily transferred from the intermediate transfer belt 20 to a recording medium P. The intermediate transfer belt 20 which has passed between the backup roll 24 and the secondary transfer roll 26 is surface-cleaned by, for example, a cleaning unit 30 with a cleaning blade disposed in the vicinity of the drive roll 22 or an erasing unit (not shown), and then repeatedly used for the next image forming process. A tray (recording medium tray) 40 is provided at a predetermined position in the housing 50, and a recording medium P such as paper in the tray 40 is conveyed by a conveying roll 32 sequentially between the intermediate transfer belt 20 and the secondary transfer roll 26 and then between two fixing rolls 28 abutting against each other, and thereafter discharged to the outside of the housing 50. In addition, more preferable examples of the image forming device of this exemplary embodiment include a device which does not have the cleaning unit 30.

EXAMPLES

Hereinafter, this exemplary embodiment will be described in detail with reference to examples, but is not limited to the following examples. "Parts" and "%" are based on the weight unless otherwise noted.

Example 1

White toners 1 to 4 and comparative white toners 5 and 6 are prepared as follows. A polyester resin is used as a binder resin, and black toner particles colored with a carbon black and white toner particles colored with a titanium dioxide are mixed to prepare a white toner. Hereinafter, a detailed description thereof will be given.

Preparation of Toner Mother Particles

Preparation of Various Dispersions

Preparation of Polyester Resin Dispersion

Preparation of Polyester Resin Particle Dispersion (1)

| | |
|---|---|
| Dimethyl Adipate: | 74 parts |
| Dimethyl Terephthalate: | 192 parts |

-continued

| | |
|---|---|
| Ethylene Oxide 2-Mol Adduct of Bisphenol A: | 216 parts |
| Ethylene Glycol: | 38 parts |
| Tetrabutoxy Titanate (catalyst): | 0.037 parts |

The above components are put into a heated and dried two-necked flask, a nitrogen gas is introduced into the container to keep the inside of the container in an inert atmosphere, and the temperature is increased with stirring. Then, the obtained material is subjected to a condensation copolymerization reaction for 7 hours at 160° C., and then the temperature is increased to 220° C. while slowly reducing the pressure to 10 Torr, and the obtained material is held for 4 hours. The pressure is released to the normal pressure, and 9 parts of trimellitic anhydride is added. The pressure is slowly reduced again to 10 Torr, and the obtained material is held for 1 hour at 220° C. Thus, a polyester resin (1) is synthesized.

The glass transition temperature of the obtained polyester resin (1) is 65° C. according to a measurement using a differential scanning calorimeter (DSC). The molecular weight of the obtained polyester resin (1) is measured by using a GPC, and the weight average molecular weight (Mw) is 12,000, and the number average molecular weight (Mn) is 4,000.

Next, 160 parts of the obtained polyester resin (1), 233 parts of ethyl acetate, and 0.1 parts of a sodium hydroxide aqueous solution (0.3 N) are put into a separable flask, heated at 70° C., and stirred using a three-one motor (manufactured by Shinto Scientific Co., Ltd.) to prepare a resin mixture. While this resin mixture is further stirred, 373 parts of ion exchanged water is slowly added to perform the phase-transfer emulsification, and the solvent is removed. Thus, a polyester resin particle dispersion (1) (solid content concentration: 30%) is obtained. The volume average particle diameter of the resin particles in the dispersion is 160 nm.

Preparation of Polyester Resin Particle Dispersion (2)

| | |
|---|---|
| Ethylene Oxide 2-Mol Adduct of Bisphenol A: | 114 parts |
| Propylene Oxide 2-Mol Adduct of Bisphenol A: | 84 parts |
| Dimethyl Fumarate: | 75 parts |
| Dodecenyl Succinic acid: | 19.5 parts |
| Trimellitic Acid: | 7.5 parts |

The above components are put into a flask equipped with a stirring device, a nitrogen introduction tube, a temperature sensor, and a rectifying column, the temperature is increased to 190° C. for 1 hour, and the reaction system is stirred. Then, 3.0 parts of a dibutyltin oxide is added thereto. While the generated water is distilled away, the temperature is increased from 190° C. to 240° C. over 6 hours, and the dehydration condensation reaction is further continuously performed for 2 hours at 240° C. to thereby synthesize a polyester resin (2).

The glass transition temperature of the obtained polyester resin (2) is 57° C., the acid value is 15.0 mgKOH/g, the weight average molecular weight (Mw) is 58,000, and the number average molecular weight (Mn) is 5,600.

Next, 160 parts of the obtained polyester resin (2), 233 parts of ethyl acetate, and 0.1 parts of a sodium hydroxide aqueous solution (0.3 N) are put into a separable flask, heated at 70° C., and stirred using a three-one motor (manufactured by Shinto Scientific Co., Ltd.) to prepare a resin mixture. While this resin mixture is further stirred, 373 parts of ion exchanged water is slowly added to perform the phase-transfer emulsification, and the solvent is removed. Thus, a polyester resin particle dispersion (2) (solid content concentration: 30%) is obtained. The volume average particle diameter of the resin particles in the dispersion is 180 nm.

Preparation of Release Agent Dispersion

| | |
|---|---|
| Paraffin Wax HNP9 (melting temperature: 74° C., manufactured by Nippon Seiro Co., Ltd., specific gravity: 0.925 g/cm$^3$): | 45 parts |
| Anionic Surfactant (manufactured by DKS Co., Ltd., NEOGEN RK): | 5 parts |
| Ion Exchanged Water: | 200 parts |

The above materials are heated at 95° C. and dispersed using a homogenizer (manufactured by IKA Works GmbH & Co. KG, ULTRA-TURRAX T50), and then subjected to a dispersion treatment using a pressure discharge-type GAULIN homogenizer (manufactured by Manton Gaulin Manufacturing Co., Inc.) to prepare a release agent dispersion (release agent concentration: 20%) having a volume average particle diameter of 0.21 μm.

Preparation of Colorant Dispersion

Preparation of Black Pigment Dispersion (1)

| | |
|---|---|
| Black Pigment (#25, manufactured by Mitsubishi Chemical Corporation, primary particle diameter: 0.047 μm): | 100 parts |
| Anionic Surfactant (manufactured by DKS Co., Ltd., NEOGEN R): | 15 parts |
| Ion Exchanged Water: | 400 parts |

The above materials are mixed, dissolved, and dispersed for 1 hour using a high-pressure impact-type dispersing machine ULTIMIZER (manufactured by Sugino Machine Limited, HJP30006) to prepare a black pigment dispersion (1) having a volume average particle diameter of 0.35 μm. The pigment concentration of the dispersion is 23%.

Preparation of White Pigment Dispersion (1)

| | |
|---|---|
| Rutile-Type Titanium Dioxide (CR-60-2: manufactured by Ishihara Sangyo Kaisha, Ltd.): | 210 parts |
| Nonionic Surfactant (NONIPOL 400: manufactured by Sanyo Chemical Industries, Ltd.): | 10 parts |
| Ion Exchanged Water: | 480 parts |

The above components are mixed and stirred for 30 minutes using a homogenizer (ULTRA-TURRAX T50: manufactured by IKA Works GmbH & Co. KG). Thereafter, a dispersion treatment is performed for 1 hour using a high-pressure impact-type dispersing machine ULTIMIZWER (HJP30006: manufactured by Sugino Machine Limited) to prepare a white pigment dispersion (1) (solid content concentration: 30%) in which white pigment particles having a volume average particle diameter of 210 nm are dispersed.

Black Toner Mother Particles (1)

| | |
|---|---|
| Ion Exchanged Water: | 1,000 parts by weight |
| Polyester Resin Particle Dispersion (1): | 100 parts by weight |
| Polyester Resin Particle Dispersion (2): | 100 parts by weight |
| Release Agent Dispersion (1): | 30 parts by weight |
| Anionic Surfactant (NEOGEN RK manufactured by DKS Co., Ltd., 20% by weight): | 5 parts by weight |

The above components are put into a reaction container equipped with a thermometer, a pH meter, and a stirrer, and held for 30 minutes at a stirring rotation speed of 150 rpm at a temperature of 30° C. while the temperature is controlled by a mantle heater from the outside.

15 parts by weight (20% by weight of the entire toner) of the black pigment dispersion (1) is added and the obtained mixture is held for 5 minutes. A 1.0 wt % nitric acid aqueous solution is added, and the pH in the aggregation process is adjusted to 3.0.

While the dispersion is performed using a homogenizer (manufactured by IKA Works GrrbH & Co. KG: ULTRA-TURRAX T50), 0.4 parts by weight of polyaluminum chloride is added. Then, while the obtained material is stirred, the temperature is increased to 50° C., and the particle diameter is measured. The volume average particle diameter is 5.5 μm. Thereafter, 110 parts by weight of the polyester resin particle dispersion (1) and 73 parts by weight of the polyester resin particle dispersion (2) are additionally added.

Thereafter, the pH is adjusted to 9.0 using a 5 wt % sodium hydroxide aqueous solution. Then, the temperature is increased to 90° C. at a rate of temperature increase of 0.05° C./min, and the obtained material is held for 3 hours at 90° C. Then, cooling, filtration, redispersion in ion exchanged water, filtration, and repeated washing are performed until the electric conductivity of the filtrate is 20 ρS/cm or less, and then vacuum drying is performed for 5 hours in an oven at 40° C. to obtain toner particles. The volume average particle diameter of the obtained black toner mother particles (1) is 7.0 μm.

Inorganic Particles

Preparation of Silica Particles

A silica sol obtained through a sol gel method is subjected to a hexamethyldisilazane (HMDS) treatment, and is dried and pulverized to obtain external additive particles of silica having a volume average particle diameter of 12 nm.

Black Toner Particles 1

100 parts by weight of the black toner mother particles (1) and 1.0 part by weight of the silica particles are mixed and blended for 30 seconds at 10,000 rpm using a sample mill. Thereafter, the obtained material is sieved using a vibration sieve having an opening size of 45 μm, and thus black toner particles 1 are prepared.

White Toner Mother Particles (2)

| | |
|---|---|
| Ion Exchanged Water: | 450 parts |
| Polyester Resin Dispersion (1): | 205 parts |
| Polyester Resin Dispersion (2): | 205 parts |
| Release Agent Particle Dispersion C1: | 100 parts |
| Anionic Surfactant (manufactured by DKS Co., Ltd.: NEOGEN RK, 20%): | 2.8 parts |

The above components are put into a 3-L reaction container equipped with a thermometer, a pH meter, and a stirrer, and held for 30 minutes at a stirring rotation speed of 150 rpm at a temperature of 30° C. while the temperature is controlled by a mantle heater from the outside.

Next, to the resultant emulsion, the following white pigment dispersion (1) is added and the obtained mixture is held for 5 minutes. A 1.0% nitric acid aqueous solution is added to adjust the pH in the aggregation process to 3.0.

White Pigment Dispersion (1): 275 parts (corresponding to 25% in the white toner particles)

Next, while the emulsion to which the white pigment dispersion (1) is added is dispersed using a homogenizer (ULTRA-TURRAX T50: manufactured by IKA Works GmbH & Co. KG), 0.4 parts of polyaluminum chloride is added. Then, while the obtained material is stirred, the temperature is increased to 50° C., and the particle diameter is measured using a COULTER COUNTER [TA-II] (aperture diameter: 50 μm, manufactured by Beckman Coulter, Inc.). The volume average particle diameter is 5.5 μm. Thereafter, 91 parts of the polyester resin particle dispersion (1) and 91 parts of the polyester resin particle dispersion (2) are additionally added to adhere the resin particles to surfaces of the aggregated particles.

Thereafter, the pH is adjusted to 9.0 using a 5 wt % sodium hydroxide aqueous solution. Then, the temperature is increased to 90° C. at a rate of temperature increase of 0.05° C./min, and the obtained material is held for 3 hours at 90° C. Then, cooling, filtration, redispersion in ion exchanged water, filtration, and repeated washing are performed until the electric conductivity of the filtrate is 20 ρS/cm or less, and then vacuum drying is performed for 5 hours in an oven at 40° C. to obtain white toner mother particles (2).

Next, with respect to 100 parts of the obtained toner mother particles (2), 1.5 parts of hydrophobic silica (manufactured by Nippon Aerosil Co., Ltd., RY50) is mixed and blended for 30 seconds at 10,000 rpm using a sample mill. Thereafter, the obtained material is sieved using a vibration sieve having an opening size of 45 μm, and thus white toner particles are prepared. The volume average particle diameter of the obtained white toner particles is 6.1 μm.

White Toner

The white toner particles and the black toner particles are mixed such that the content of the black toner particles with respect to the total number of the white toner particles and the black toner particles is 0.01% by number, 0.1% by number, 0.3% by number, and 1.0% by number, and uniformly agitated to prepare a white toner 1, a white toner 2, a white toner 3, and a white toner 4, respectively.

The white toner particles and the black toner particles are mixed such that the content of the black toner particles is 0.005% by number and 5.0% by number in the respective cases, and uniformly agitated to prepare, as toners for comparison, a comparative white toner 5 and a comparative white toner 6 in the same manner. A white toner containing no black toner particles is designated as a white toner 7.

Carrier A

| | |
|---|---|
| Ferrite Particles (manufactured by Powdertech, volume average particle diameter: 35 μm): | 100 parts |
| Toluene: | 14 parts |
| Perfluorooctyl Ethyl Acrylate/Methyl Methacrylate Copolymer (copolymerization ratio = 40:60, weight average molecular weight Mw = 50,000): | 0.8 parts |
| Carbon Black (VXC-72; manufactured by Cabot Corporation): | 0.06 parts |
| Crosslinked Melamine Resin Particles (number average particle diameter; 0.3 μm): | 0.15 parts |

The above components except for the ferrite particles are dispersed by a stirrer for 10 minutes to prepare a coating film forming liquid. This coating film forming liquid and the ferrite particles are put into a vacuum deaeration-type kneader and stirred for 30 minutes at 60° C., and then the toluene is distilled away by reducing the pressure to form a resin coating film on surface of the ferrite particles, and thus, a carrier A is prepared.

Next, the white toner 1, 2, or 3, or the comparative white toner 5 or 6 is mixed with the carrier A such that each toner is 8% by weight with respect to the carrier A, so that developers 1, 2, and 3, and developers for comparison 5 and 6 are prepared. In the mixing, a V-blender is used as a mixer.

Evaluation of White Toner

The developer using the obtained white toner is mounted on a modified copier DOCUCENTRE COLOR f450 manufactured by Fuji Xerox Co., Ltd. (modified to add an image unit for forming a white image to a quadruple tandem configuration), and is adjusted such that the toner weight on paper is 6 g/m$^2$ under the environment of 23° C. and 55% RH, and an image is formed on J-paper manufactured by Fuji Xerox Co., Ltd.

As the image, an image for evaluation (solid image of 30 mm×40 mm), which is white color (image density coverage: 100%) is output, and the fixing temperature is set to 160° C. The ISO whiteness degree (ISO 2470) was measured, and the whiteness degrees of the white toners Nos. 1 to 4 and the comparative white toners C5 and C6 are shown in Table 1.

Whiteness Degree of White Toner

The whiteness degree of a solid image having a white toner applied amount of 6 g/m$^2$ is measured by the international ISO whiteness degree (ISO 2470), and the obtained results are shown in the following Table 1. The letter "C" indicates that the toner is for comparison.

TABLE 1

| | White Toner No. | Content of Black Toner Particles (% by number) | ISO Whiteness Degree (%) |
|---|---|---|---|
| 1 | 1 | 0.01 | 89.3 |
| 2 | 2 | 0.1 | 86.5 |
| 3 | 3 | 0.3 | 83.9 |
| 4 | 4 | 1.0 | 80.3 |
| C5 | 5 | 0.005 | 91.2 |
| C6 | 6 | 5.0 | 70.3 |
| C7 | 7 | 0 | 93.0 |

Example 2

Evaluation as Correction Ink (Partial Hiding Ink)

The white toner is used as a correction ink on recording sheets which have different whiteness degrees and on which a line of Gothic letters of 12-point font size is printed. The modified portion in the recording sheet after the modification is visually observed and evaluated based on the following standards, and the obtained results are shown in Table 2.

The standards for the evaluation as the correction ink are as follows.

A: There are no problems since the modified portion may be hardly distinguished.

B: There are almost no problems since the modified portion is inconspicuous.

C: There are no problems in practical use since the modified portion is almost inconspicuous.

D: The modified portion appears to be floating and is unnatural.

TABLE 2

| | White Toner No. | Whiteness Degree of Recording Sheet | Whiteness Degree of Solid Image of White Toner | Evaluation Result |
|---|---|---|---|---|
| 1 | 4 | Recycled Paper, 70% | 75% | B |
| 2 | 1 | Fuji Xerox Co., Ltd., C2-Paper, 84% | 88% | C |
| 3 | 2 | Fuji Xerox Co., Ltd., C2-Paper, 84% | 85% | B |

TABLE 2-continued

| | White Toner No. | Whiteness Degree of Recording Sheet | Whiteness Degree of Solid Image of White Toner | Evaluation Result |
|---|---|---|---|---|
| 4 | 3 | Fuji Xerox Co., Ltd., C2-Paper, 84% | 82% | A |
| 5 | 4 | Fuji Xerox Co., Ltd., C2-Paper, 84% | 80% | C |
| 6 | 5 | Fuji Xerox Co., Ltd., C2-Paper, 84% | 90% | D |
| 7 | 6 | Fuji Xerox Co., Ltd., C2-Paper, 84% | 72% | D |
| 8 | 1 | Fuji Xerox Co., Ltd., J-Paper, 89% | 89% | A |

Example 3

A landscape photograph including a white cloud having a shadow is printed on fine quality paper (Fuji Xerox Co., Ltd., JD COAT, whiteness degree: 85%) having an ISO whiteness degree of 85%. Using the white toner No. 4 and the comparative white toner No. 7 described in Example 1, this landscape photograph is reproduced, and the following results are obtained when function evaluation is performed by 10 panelists.

Method of Forming Image of White Cloud Having Shadow

There are the following two methods as the method of expressing a shadow portion in an image of a cloud having a shadow.

(1) Method of Changing Amount of White Toner Containing Black Toner Particles Applied (2) Method of Changing Amount of Black Toner Applied In addition, there are the following three methods as the method of expressing a highlight portion having the highest whiteness.

(3) Method Using White Toner Containing Black Toner Particles (White Toners 1 to 4)

(4) Method Using White Toner 7 Containing No Black Toner Particles (5) Method Using White Color of Recording Sheet without Placing Toner An image reproduced by using a combination of these methods is evaluated according to the following evaluation standards, and thus the results shown in Table 3 are obtained.

The standards for the evaluation when the white toner is used to form an off-white image are as follows.

Standards for Evaluation of Reproduction of Slightly Grayish White Color in Reproduction of Intermediate Color in Highlight Region A: Good B: Generally good (there are no major defects)

C: Slightly unnatural, although there are no problems in practical use.

D: Unnatural and unsuitable for practical use.

TABLE 3

| | Toner Used in Highlight Portion | Toner Used in Expression of Shadow Portion | Method of Expressing Shadow | Result of Evaluation of Reproduction of Shadow |
|---|---|---|---|---|
| 1 | White Toner 4 | White Toner 4 | Change Amount of White Toner Applied | A |

TABLE 3-continued

| | Toner Used in Highlight Portion | Toner Used in Expression of Shadow Portion | Method of Expressing Shadow | Result of Evaluation of Reproduction of Shadow |
|---|---|---|---|---|
| 2 | Not Used | White Toner 4 | Change Amount of White Toner Applied | B |
| 3 | Comparative White Toner 7 | Black Toner | Change Amount of Black Toner Applied | D |
| 4 | Not Used | Black Toner | Change Amount of Black Toner Applied | D |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A white toner comprising:

white toner particles; and black toner particles, wherein a content of the black toner particles is from 0.01% by number to 03% by number with respect to a total number of an entirety of toner particles.

2. The white toner according to claim 1, wherein an image whiteness degree of the white toner is in the range of from 80% to 90%.

3. The white toner according to claim 1, wherein a binder resin contained in the black toner particle contains a first polyester resin, and a binder resin contained in the white toner particle contains a second polyester resin.

4. The white toner according to claim 3, wherein the first polyester resin is same as the second polyester resin.

5. The white toner according to claim 1, wherein an image whiteness degree of the white toner is in the range of from 85% to 90%.

6. The white toner according to claim 1, wherein the white toner particles contain a white pigment in the range of from 20 parts by weight to 60 parts by weight with respect to 100 parts by weight of toner mother particles for the white toner particles.

7. A white toner set comprising:

a plurality of white toners, wherein the respective white toners are the white toners according to claim 1 having different whiteness degrees.

8. A colored toner set comprising:

the white toner according to claim 1; and a colored toner.

9. The colored toner set according to claim 8, wherein the colored toner is selected from a group consisting of a yellow toner, a cyan toner, a magenta toner, and a black toner.

10. The white toner according to claim 1, wherein a content of the black toner particles is from 0.1% by number to 0.3% by number with respect to a total number of an entirety of toner particles.

* * * * *